US009892670B2

(12) United States Patent
Seo et al.

(10) Patent No.: US 9,892,670 B2
(45) Date of Patent: Feb. 13, 2018

(54) POWER MANAGEMENT DRIVER AND DISPLAY DEVICE HAVING THE SAME

(71) Applicant: SAMSUNG DISPLAY CO., LTD., Yongin-si, Gyeonggi-Do (KR)

(72) Inventors: Jeong-Min Seo, Cheonan-si (KR); Sung-Chun Park, Suwon-si (KR)

(73) Assignee: Samsung Display Co., Ltd., Yongin-si, Gyeonggi-do (KR)

( * ) Notice: Subject to any disclaimer, the term of this patent is extended or adjusted under 35 U.S.C. 154(b) by 354 days.

(21) Appl. No.: 14/837,119

(22) Filed: Aug. 27, 2015

(65) Prior Publication Data

US 2016/0293106 A1 Oct. 6, 2016

(30) Foreign Application Priority Data

Apr. 3, 2015 (KR) ..... 10-2015-0047415

(51) Int. Cl.
*G05F 1/577* (2006.01)
*G09G 3/20* (2006.01)

(52) U.S. Cl.
CPC ..... *G09G 3/20* (2013.01); *G09G 2330/021* (2013.01); *G09G 2330/028* (2013.01)

(58) Field of Classification Search
CPC ..... G09G 2330/02; G09G 2330/021; G09G 2310/0264; G09G 3/3696; H02M 2001/009; H02M 3/1584; H02M 2001/0045; G05F 1/577; G05F 1/613; G05F 1/62; G05F 1/563
See application file for complete search history.

(56) References Cited

U.S. PATENT DOCUMENTS 6,762,595 B2 * 7/2004 Tamai ..... G06F 1/26 323/266
7,057,378 B2 * 6/2006 Oyama ..... G05F 1/575 323/267
7,280,104 B2 * 10/2007 Morita ..... G06F 1/263 345/204
7,956,857 B2 * 6/2011 Willis ..... G09G 3/3622 345/204
8,373,396 B2 * 2/2013 Huang ..... G05F 1/56 323/270

FOREIGN PATENT DOCUMENTS

KR 10-2010-0098826 A 9/2010
KR 10-2012-0135443 12/2012
KR 10-2013-0034852 A 4/2013
KR 10-2014-0008665 A 1/2014

* cited by examiner

*Primary Examiner* — Gary L Laxton
(74) *Attorney, Agent, or Firm* — Lee & Morse P.C.

(57) ABSTRACT

A power management driver includes a boost converter, a plurality of regulators, a sequence controller, and an operation controller. The boost converter converts an input voltage to a source drive voltage for drive a source driver based on a drive enable signal. The regulators regulate the source drive voltage to generate a plurality of drive voltages. The regulators corresponding to a respective number of predetermined devices. The sequence controller controls the timing for providing the source drive voltage to the source driver. The operation controller adjusts active periods of first and second control signals to control the regulators and the sequence controller.

20 Claims, 9 Drawing Sheets

POWER MANAGEMENT DRIVER AND DISPLAY DEVICE HAVING THE SAME

CROSS REFERENCE TO RELATED APPLICATION

Korean Patent Application No. 10-2015-0047415, filed on Apr. 3, 2015, and entitled, "Power Management Driver and Display Device Having the Same," is incorporated by reference herein in its entirety.

BACKGROUND

1. Field

One or more embodiments described herein relate to a power management driver and a display device having a power management driver.

2. Description of the Related Art

Mobile phones, tablets, personal digital assistants, notebook computers, and other portable and/or mobile electronic devices have a power management driver for controlling a display. An example of a power management driver is a Power Management Integrated Circuit (PMIC).

According to one arrangement, the PMIC outputs voltages for driving the display at predetermined timings. The voltages are output based on an input voltage and an enable signal. To perform these functions, the PMIC may include at least one boost converter and/or a plurality of low-dropout (LDO) regulators. The boost converter(s) and/or LDO regulators control a voltage output sequence of the PMIC. However, the size of the PMIC may increase and consume more power as the number and/or size of the output voltages increase.

SUMMARY

In accordance with one or more embodiments, a power management driver includes a boost converter to convert an input voltage to a source drive voltage to drive a source driver based on a drive enable signal; a plurality of regulators to regulate the source drive voltage to generate a plurality of drive voltages, the regulators corresponding to a respective number of predetermined devices; a sequence controller to control a timing for providing the source drive voltage to the source driver; and an operation controller to adjust active periods of first and second control signals to control the regulators and the sequence controller.

The regulators may output the drive voltages when the first control signal is activated, and the sequence controller may output the source drive voltage when the second control signal is activated. The operation controller may activate the second control signal after activating the first control signal having a predetermined delay time.

The sequence controller may include a pass transistor circuit having a gate electrode to receive the second control signal from the operation controller, a first electrode electrically connected to the boost converter, and a second electrode electrically connected to an output terminal for outputting the source drive voltage; and a comparator to compare a first voltage at the first electrode and a second voltage at the second electrode.

The pass transistor circuit may include a first body diode connected to the first electrode in a direction of the second electrode; a second body diode connected to the second electrode in a direction of the first electrode and connected to the first body diode in series; a first switch connected to the first body diode in parallel; and a second switch connected to the second body diode in parallel, wherein the first and second switches are to be selectively turned on based on an output of the comparator.

When the first voltage is greater than a sum of the second voltage and a threshold voltage of the pass transistor circuit, the first switch may be turned on and the second body diode may stop the first voltage from reaching the output terminal. When the first voltage is less than or equal to the sum of the second voltage and the threshold voltage of the pass transistor circuit, the first switch may be turned off. When the first and second signals are activated, the first switch may be turned off and the second switch may be turned on to transmit the source drive voltage to the output terminal.

The source drive voltage may correspond to an uppermost voltage for driving a plurality of output buffers in the source driver. The sequence controller may be connected to an external voltage source to independently receive the source drive voltage. The regulators may be low-dropout regulators.

In accordance with one or more other embodiments, a display device includes a display panel including a plurality of pixels; a source driver to provide a data voltage to the display panel; a gate driver to provide a gate signal to the display panel; a power management driver to control a plurality of drive voltages to be provided to the display panel, the source driver, and the gate driver; and a timing controller to control the source driver, the gate driver, and the power management driver, wherein the power management driver includes: a boost converter to convert an input voltage to a source drive voltage for driving the source driver based on a drive enable signal; a plurality of regulators to regulate the source drive voltage to generate the plurality of drive voltages; a sequence controller to control a timing to provide the source drive voltage to the source driver; and an operation controller to adjust active periods of first and second control signals to control the regulators and the sequence controller.

The display device may include an emission driver to provide an emission signal to control emission of the pixels. The power management driver may provide an emission drive voltage to the emission driver to drive the emission driver. The regulators may output the drive voltage when the first control signal is activated, and the sequence controller may output the source drive voltage when the second control signal is activated. The operation controller may activate the second control signal after activating the first control signal having a predetermined delay time. The display device may include a voltage source to generate the source drive voltage and to provide the source driver voltage to the sequence controller.

The sequence controller may include a pass transistor circuit having a gate electrode to receive the second control signal from the operation controller, a first electrode electrically connected to the boost converter, and a second electrode electrically connected to an output terminal to transmit the source drive voltage to the source driver; a comparator to compare a first voltage at the first electrode and a second voltage at the second electrode; a first body diode connected to the first electrode in a direction of the second electrode; a second body diode connected to the second electrode in a direction of the first electrode and connected to the first body diode in series; a first switch connected to the first body diode in parallel; and a second switch connected to the second body diode in parallel, wherein the first and second switches are to be selectively turned on based on an output of the comparator.

The boost converter may provide the source drive voltage to the sequence controller. The source drive voltage may correspond to an uppermost voltage for driving a plurality of output buffers included in the source driver.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
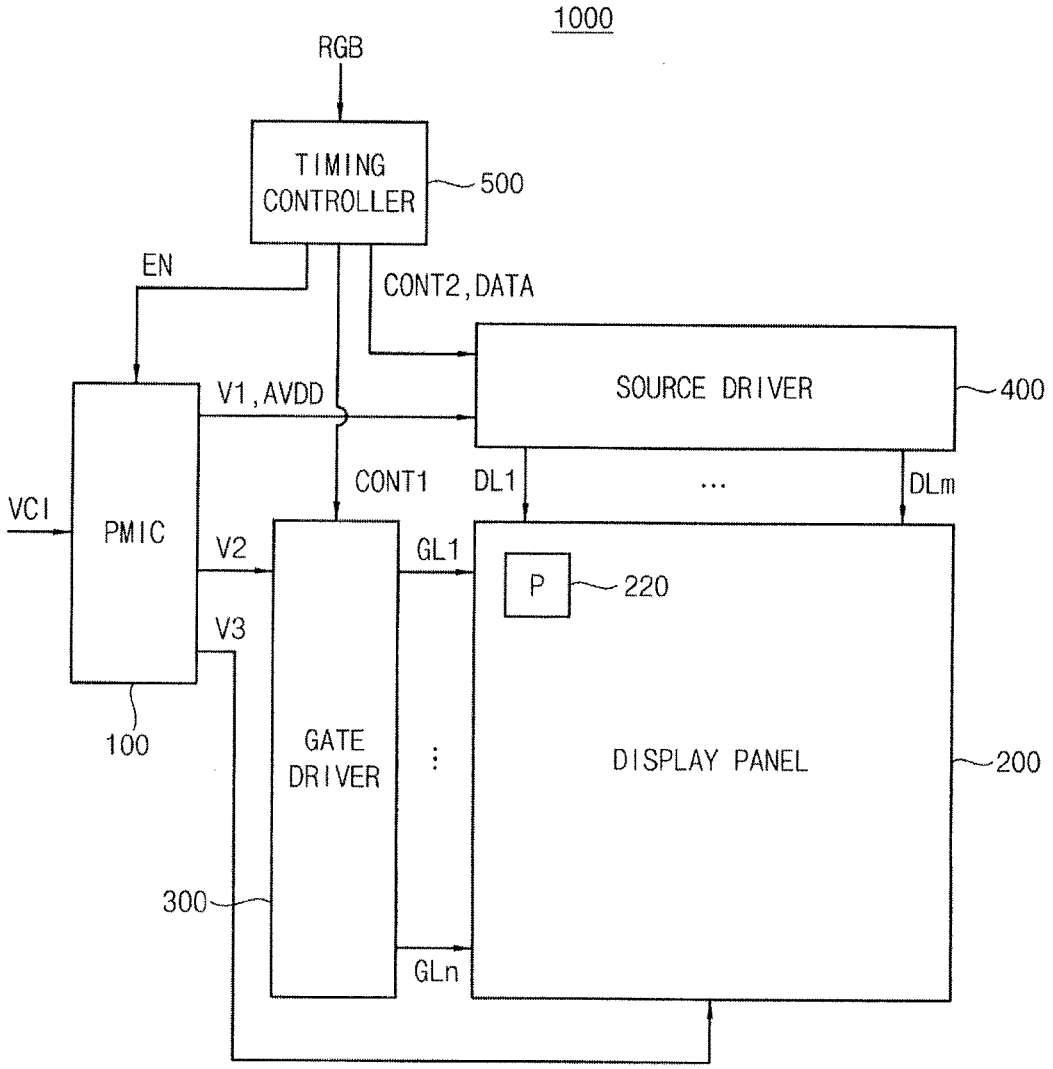
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a display device 1000 which includes a power management driver 100, a display panel 200, a gate driver 300, a source driver 400, and a timing controller 500. The display device 1000 may be, for example, an organic light emitting diode display, a liquid crystal display, or another display device.

The power management driver 1000 controls one or more drive voltages (e.g., a level of a drive voltage, a sequence of a drive voltage, etc.) provided to the display panel 200, the gate driver 300, and the source driver 400. The power management driver 100 includes a boost converter, a plurality of regulators, a sequence controller, and an operation controller. The boost converter converts an input voltage VCI to a source drive voltage AVDD for driving the source driver 400 based on a drive enable signal EN. The regulators regulate the source drive voltage AVDD to generate a plurality of drive voltages V1, V2, and V3. The sequence controller controls the timing at which the source drive voltage AVDD is provided to the source driver 400. The operation controller adjusts active periods of first and second control signals to control the regulators and sequence controller. The drive voltages V1, V2, and V3 may be applied to the source driver 400, the gate driver 300, and the display panel 200, respectively.

In one embodiment, the regulators may output the drive voltage V1, V2, and V3 when the first control signal is activated. The sequence controller may provide the source drive voltage AVDD to the source driver 400, for example, when the second control signal is activated. In one embodiment, the drive voltage V1 may correspond to an uppermost gamma voltage and a lowermost gamma voltage for driving the source driver 4000. The drive voltage V2 may correspond to a high direct current (DC) voltage and a low DC voltage for driving the gate driver 300. The drive voltage V3 may correspond to an initialization voltage for initializing pixels, e.g., anodes of organic light emitting diodes in the display panel 200. The operation controller may activate the second control signal after activating the first control signal having a predetermined delay time.

In one embodiment, the sequence controller may be connected to an external voltage source to independently receive the source drive voltage AVDD. For example, the display device 1000 may include a voltage source or a battery to generate the source drive voltage AVDD to be provided to the sequence controller.

The display panel 200 displays images. The display panel 200 includes a plurality of gate lines GL1 to GLn, a plurality of data lines DL1 to DLm, and a plurality of pixels 220 connected to the gate lines GL1 to GLn and the data lines DL1 to DLm. The pixels 220 may be arranged, for example, in a matrix form. In one embodiment, there may be n number of gate lines GL1 to GLn and m number of the data lines DL1 to DLm, where n and m are positive integers. In one embodiment, the number of the pixels 220 is n×m.

The gate driver 300 applies gate signals to drive the gate lines GL1 to GLn based on a gate control signal CONT1 from the timing controller 500 and the drive voltage V2 from the power management driver 100. The gate driver 100 sequentially or concurrently outputs the gate signals to the gate lines GL1 to GLn in each frame. In one embodiment, the gate driver 300 includes a shift register, a level shifter, an output buffer.

The source driver 400 converts an output image signal DATA to a data voltage of an analog type based on a source control signal CONT2 from the timing controller 500 and the source drive voltage AVDD and the drive voltage V1 from the power management driver 100. The source driver may apply the data voltage to the data lines DL1 to DLm. In one embodiment, the source driver 400 includes a gamma block for generating a plurality of gamma voltages and a data drive block for generating the data voltage based on the gamma voltages. The data drive block may include a shift register, a latch block, a digital-analog converter (DAC), and an output buffer. In one embodiment, the source drive voltage may be provided to the output buffer to control the output operation timing of the source driver 400.

The timing controller 500 receives an input control signal and an input image signal RGB from an image source, e.g., a graphic apparatus. The timing controller 500 generates the output image signal DATA, which, for example, may be a digital signal, based on operating conditions of the display panel 200 and the input image signal RGB. In addition, the timing controller 500 may generate the gate control signal CONT1 for controlling a driving timing of the gate driver 300 and the source control signal CONT2 for controlling a driving timing of the source driver 400 based on the input control signal CONT. The timing controller 500 may output the gate and source control signals CONT1 and CONT2 to the gate driver 300 and the source driver 400, respectively. The timing controller 500 may generate the drive enable signal EN for controlling a driving timing of the power management driver 100 based on the input control signal, and output the drive enable signal EN to the power management driver 100.

Figure 2:
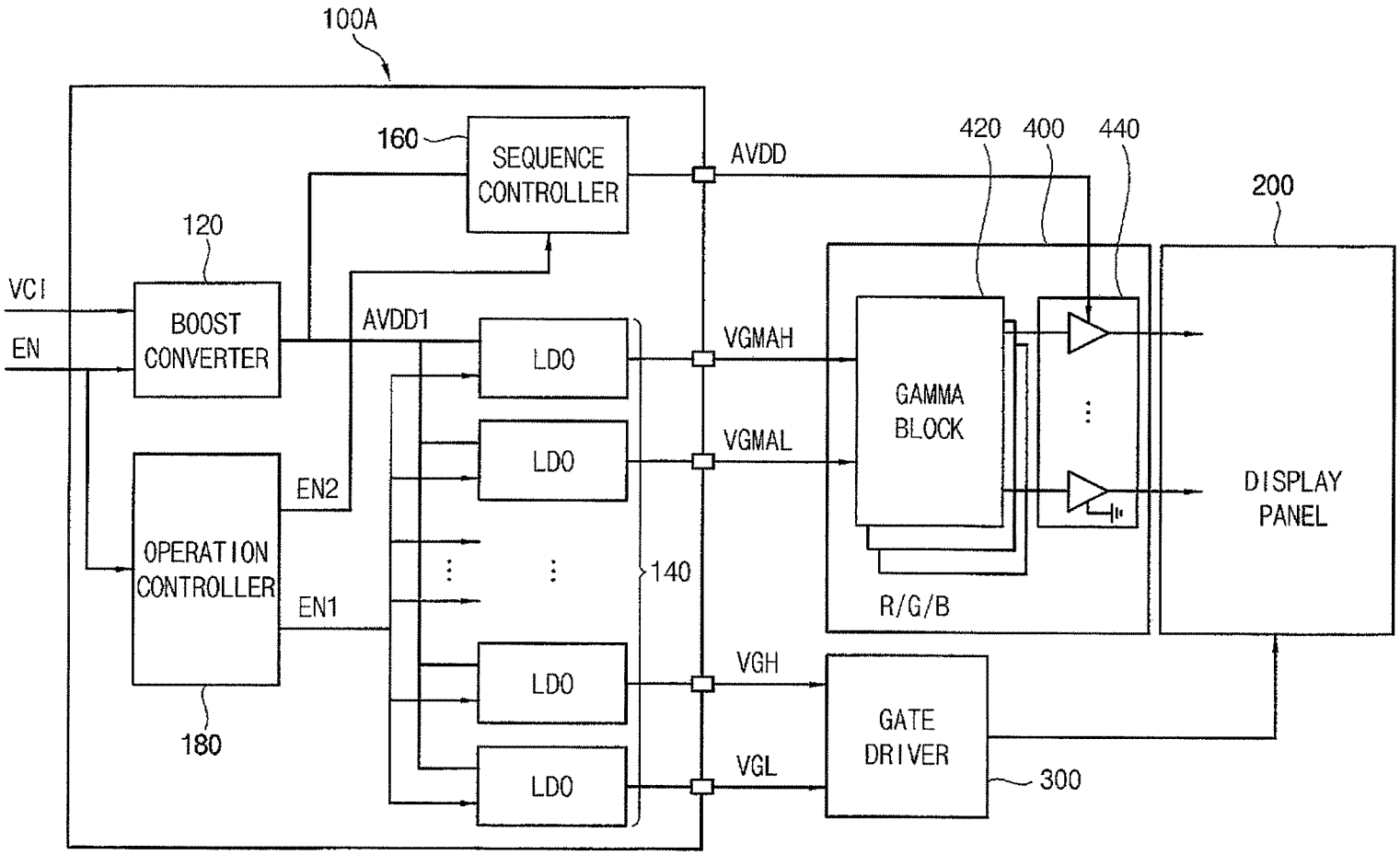
FIG. 2 illustrates an embodiment of a power management driver.

FIG. 2 illustrates an embodiment of the power management driver 100A illustrated in FIG. 1. Referring to FIGS. 1 and 2, the power management driver 100A includes a boost converter 120, a plurality of regulators 140, a sequence controller 160, and an operation controller 180.

The boost converter 120 converts an input voltage VCI to a source drive voltage AVDD1 for driving the source driver 400 based on a drive enable signal EN. The boost converter 120 outputs the source drive voltage AVDD1 by boosting the input voltage VCI. For example, the input voltage may be about 3.3V and the source drive voltage may be about 7V. The source drive voltage AVDD1 may be the uppermost voltage among voltages output from the power management driver 100A. The boost converter 120 provides the source drive voltage AVDD1 to the regulators 140 and the sequence controller 160. The source drive voltage AVDD1 may correspond to a voltage for driving a plurality of output buffers 440 in the source driver 400. Accordingly, the source drive voltage AVDD output from the sequence controller 160 may be applied to the output buffers 440 of the source driver 400. Each of the output buffers 440 may include an operational amplifier (OP-AMP).

The voltage level of the source drive voltage AVDD1 output from the boost converter 120 may be substantially the same as a voltage level of the source drive voltage AVDD output from the sequence controller 160. In one embodiment, the source drive voltage AVDD output from the sequence controller 160 may be less than the source drive voltage AVDD1 output from the boost converter 120 based on a conduction loss between an output terminal of the boost converter 120 and sequence controller 160.

The regulators 140 regulate the source drive voltage AVDD1 to generate a plurality of drive voltages, each corresponding to a device such as a gate driver 300, the source driver 400, etc. In one embodiment, the regulators 140 may be Low-dropout (LDO) regulators. Some of the regulators 140 may generate the uppermost gamma voltage VGMAH and the lowermost gamma voltage VGMAL for generating gamma voltages based on the source drive voltage AVDD1. The uppermost gamma voltage VGMAH and the lowermost gamma voltage VGMAL may be provided to a gamma block 420 in the source driver 400.

Some of the regulators 140 may generate a high DC voltage VGH and a low DC voltage VGL for driving the gate driver 300. The high DC voltage VGH and the low DC voltage VGL may be applied to a level shifter in the gate driver 300. In one embodiment, one of the regulators 140 may generate an initialization voltage applied to an initialization circuit, when a pixel in display panel 200 includes an initialization circuit. The drive voltages may be generated and/or applied differently in another embodiment.

The sequence controller 160 controls the timing at which the source drive voltage AVDD1 is provided to the source driver 400. The high DC voltage VGH, the low DC voltage VGL, the initialization voltage applied to the display panel 200, etc., must be output before the power management driver 100A outputs the source drive voltage AVDD to operate the display device 1000 normally. The sequence controller 160 outputs the source drive voltage AVDD later than the output of the high DC voltage VGH and the low DC voltage VGL. Accordingly, in at least this embodiment, internal elements of the power management driver 100A control the output timing of the source drive voltage AVDD (or output sequence of the drive voltages). In one embodiment, the sequence controller 160 includes a pass transistor circuit serving as an output switch of the source drive voltage AVDD and a comparator to control the pass transistor circuit.

The operation controller 180 adjusts active periods of first and second control signals EN1 and EN2 to control the regulators 140 and the sequence controller 160. The operation controller 180 generates the first and second control signals EN1 and EN2 based on the drive enable signal EN. The first control signal EN1 may be applied to the regulators 140 to control output timings of the drive voltages. The second control signal EN2 may be applied to the sequence controller 160 and control the output timing of the source drive voltage AVDD. For example, the second control signal EN2 may be applied to a gate electrode of the pass transistor circuit to control a turned-on timing of the pass transistor circuit.

In one embodiment, the regulators 140 may output the drive voltages (e.g., VGMAH, VGMAL, VGH, and VGL) when the first control signal EN1 is activated. The sequence controller 160 may output the source drive voltage AVDD when the second control signal EN2 is activated. In one embodiment, the operation controller 180 may activate the second control signal EN2 after activating the first control signal EN1 having a predetermined delay time.

Thus, in this embodiment, the power management driver 100A includes the sequence controller 160 for controlling output sequence of the drive voltages including the source drive voltage AVDD. The output sequence of the drive voltages may be determined by the sequence controller 160 inside the power management driver 100A. As a result, power consumption for driving the power management driver 100A and the display device 1000 may be reduced. Further, the power management driver has simple structure because of the simple structure of the sequence controller compared, for example, with a boost converter structure or an LDO regulator structure.

Figure 3:
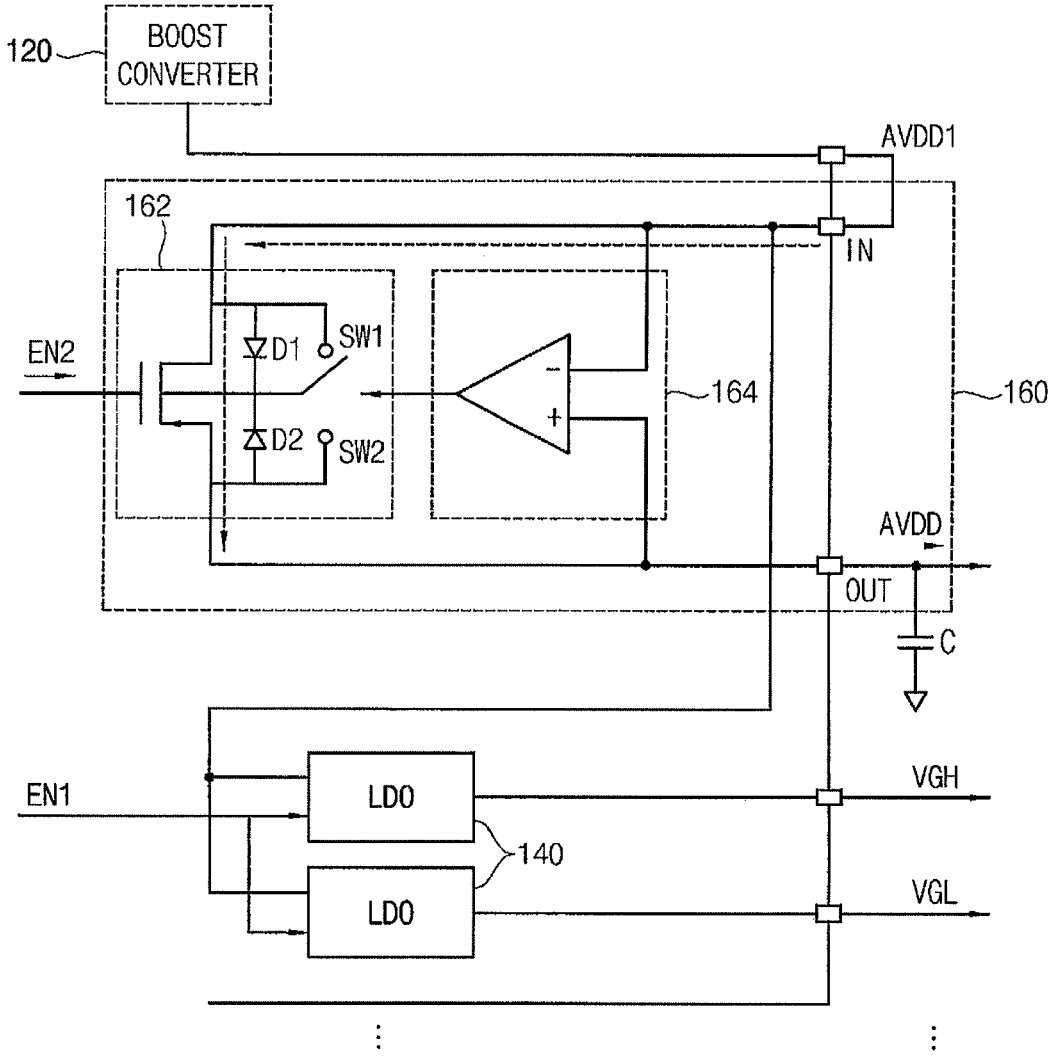
FIG. 3 illustrates an embodiment of a sequence controller.

FIG. 3 illustrates an embodiment of the sequence controller 160 in the power management driver 100A of FIG. 2. Referring to FIGS. 2 and 3, the sequence controller 160 includes a pass transistor circuit 162 and a comparator 164.

The pass transistor circuit 162 has a gate electrode to receive the second control signal EN2 from the operation controller 180, a first electrode electrically connected to the boost converter 120, and a second electrode electrically connected to an output terminal OUT for outputting the source drive voltage AVDD. The pass transistor circuit 162 may be a P-channel metal oxide semiconductor (PMOS) transistor or an N-channel metal oxide semiconductor (NMOS) transistor.

The pass transistor circuit 162 may include a first body diode D1 connected to the first electrode in a direction of the second electrode and a second body diode D2 connected to the second electrode in a direction of the first electrode. The first and second body diodes D1 and D2 may be connected in series. When the pass transistor circuit 162 is deactivated, the second body diode D2 may prevent a voltage of the output terminal OUT from reaching a voltage level of the source drive voltage AVDD. The pass transistor circuit 162 may further include a first switch SW1 connected to the first body diode D1 in parallel and a second switch SW2 connected to the second body diode D2 in parallel. The first and second switches SW1 and SW2 may be selectively turned on based on an output of the comparator 164.

In one embodiment, the pass transistor circuit 162 is connected to an input terminal IN to receive an output (e.g., AVDD1) of the boost converter 120. The pass transistor circuit 162 may include a MOS transistor having very low on-state resistance to reduce conduction loss at the pass transistor circuit 162.

The comparator 164 compares a first voltage (e.g., a voltage at the first electrode) and a second voltage (e.g., a voltage at the second electrode). The first and second switches SW1 and SW2 may be switched based on the output of the comparator 164. The second switch SW2 is turned off when the first switch SW1 is turned on, and the first switch SW1 is turned off when the second switch SW2 is turned on. When the first switch SW is turned off and the second switch is turned on, and if the pass transistor is activated by the second control signal EN2, the output terminal OUT outputs the source drive voltage AVDD.

In one embodiment, when the first voltage is greater than a sum of the second voltage and a threshold voltage of the pass transistor circuit 162, the first switch SW1 may be turned on and the second switch SW2 may be turned off. In this case, the second body diode D2 stops the first voltage (e.g., AVDD1/AVDD) from reaching the output terminal OUT. When the first voltage is less than or equal to the sum of the second voltage and the threshold voltage of the pass transistor circuit 162, the first switch SW1 may be turned off and the second switch SW2 may be turned on.

The sequence controller 160 may further include a capacitor C connected between the output terminal OUT and a reference voltage, e.g., ground. The capacitor C may prevent ripple and/or alternating current (AC) noise due to the switching operation of the pass transistor circuit 162.

Figure 4:
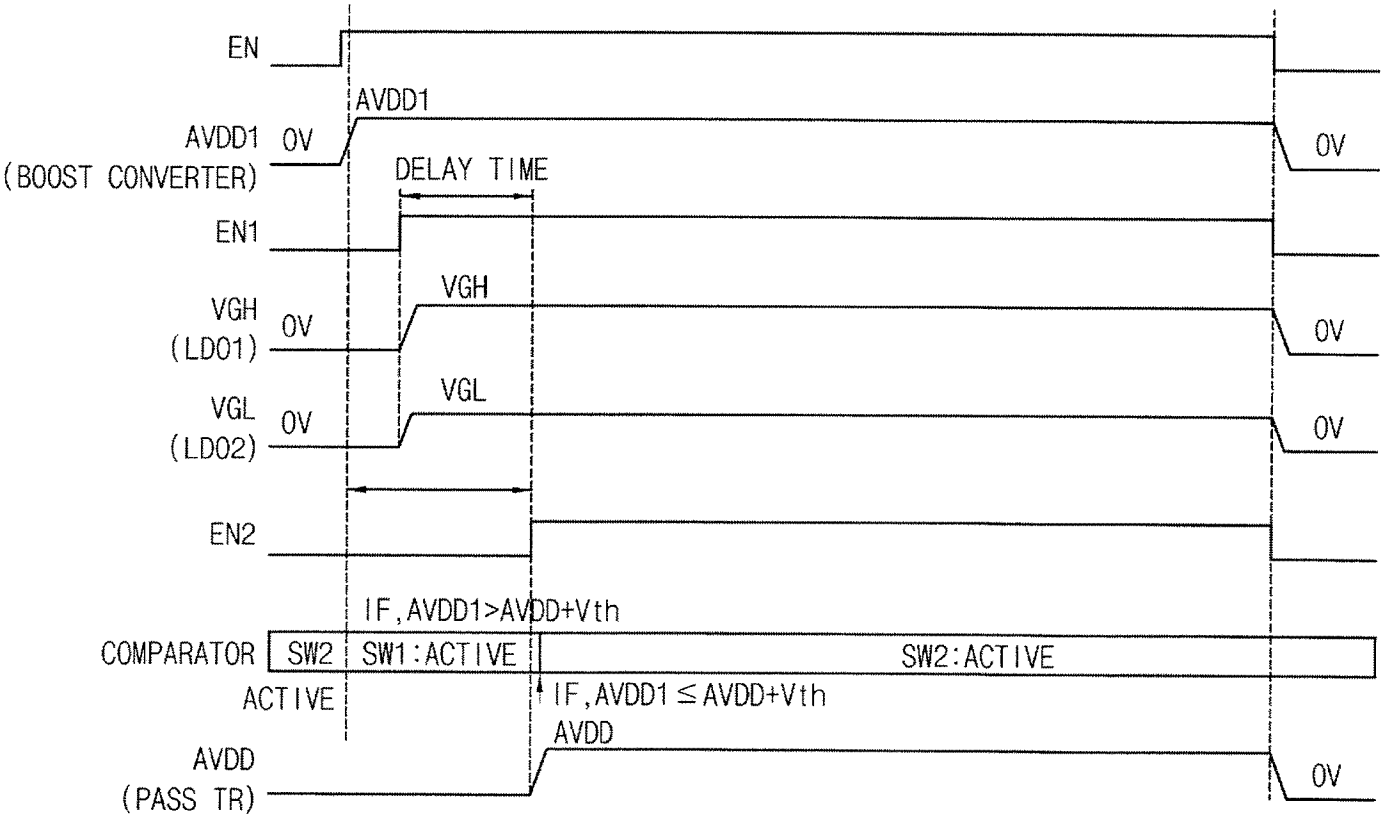
FIG. 4 illustrates control signals for the power management driver.
Figure 5:
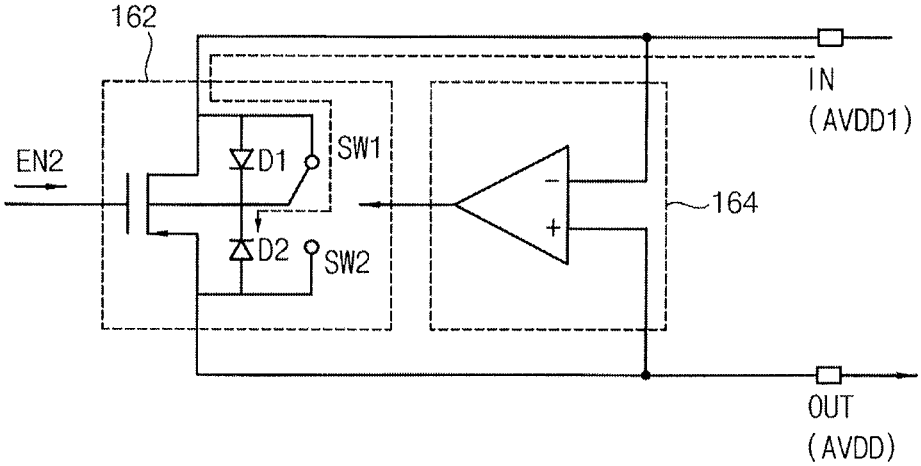
FIG. 5 illustrates an example of a circuit of the power management driver.
Figure 6:
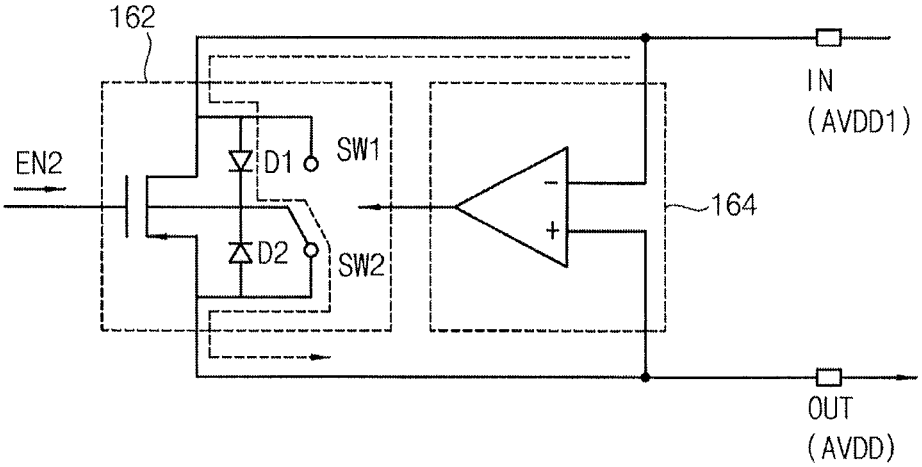
FIG. 6 illustrates another example of a circuit of the power management driver.

FIG. 4 illustrates an example of control signals for the power management driver 100A in FIG. 2. FIG. 5 illustrates an example of a circuit of the power management driver 100A in FIG. 2. FIG. 6 illustrates another example of a circuit of the power management driver 100A in FIG. 2.

Referring to FIGS. 2 to 6, power management driver 100A controls the output sequence of the drive voltages based on operation of the sequence controller 160. As illustrated in FIG. 4, when an activated drive enable signal EN is applied to the boost converter 120 in an deactivated state of the first and second control signals EN1 and EN2, the boost converter 120 generates the source driver voltage AVDD1 having a voltage level AVDD1. An output voltage of the boost converter 120 (e.g., AVDD1) may be transmitted to the first electrode of the pass transistor 160 through the input terminal IN of the sequence controller 160. Thus, the first voltage (e.g., a first electrode voltage of the pass transistor circuit 162) may have a voltage level substantially same as the output voltage of the boost converter 120, e.g., AVDD1. The second voltage (e.g., a second electrode voltage of the pass transistor circuit 162) may be about 0V.

The comparator compares the first voltage (e.g., a voltage level of the input terminal IN, AVDD1) and the second voltage (e.g., a voltage level of the output terminal OUT, AVDD). When the first voltage AVDD1 is greater than a sum of the second voltage AVDD and a threshold voltage Vth of the pass transistor circuit 162 (e.g., AVDD1>AVDD+Vth) as illustrated in FIG. 5, the first switch SW1 may be turned on and the second switch SW2 may be turned off. In this case, the second body diode D2 stops the first voltage AVDD1 from reaching the output terminal OUT.

Then, when the first control signal EN1 is activated, regulators 140 operate. For example, as illustrated in FIG. 4, a first LDO regulator LDO1 may generate and provide the high DC voltage VGH to the gate driver 300, and the second LDO regulator LDO2 may generate and provide the low DC voltage VGL to the gate driver 300. In this case, the first voltage AVDDD1 is greater than a sum of the second voltage AVDD and a threshold voltage Vth of the pass transistor circuit 162. As a result, the turned-on state of the first switch SW1 is maintained.

Then, when the second control signal EN2 is activated, the pass transistor circuit 162 may be turned on. In one embodiment, as illustrated in FIG. 4, the operation controller 180 activates the second control signal EN2 after activating the first control signal EN1 having a predetermined delay time. When the pass transistor 162 is turned on, the second voltage AVDD may increase. When the first voltage AVDD1 is less than or equal to the sum of the second voltage AVDD and the threshold voltage Vth of the pass transistor circuit 162 (e.g., AVDD1≤AVDD+Vth) as illustrated in FIG. 6, the first switch SW1 may be turned off. In this case, the first voltage AVDD1 is applied to the output terminal OUT through the first diode D1 and the second switch SW2. In other words, the source drive voltage AVDD may be transmitted to the output terminal OUT when the second control signal EN2 is activated.

The first and second voltages AVDD1 and AVDD may be substantially the same. Also, in one embodiment, they may correspond to the source drive voltage. In one embodiment, the second voltage AVDD output from the sequence controller 160 may be less than the first voltage AVDD1 output from the boost converter 120 based on a conduction loss between an output terminal of the boost converter 120 and the sequence controller 160. A turned-on state of the second switch SW2 may be maintained during a period in which the second control signal EN2 is activated, so that a voltage level of the output terminal OUT may maintain the source drive voltage AVDD within the period.

Then, when the drive enable signal EN, the first control signal EN1, and the second control signal EN2 are deactivated, the boost controller 120 stops outputting the source drive voltage (AVDD1) and the regulators 140 stop operating. In addition, the pass transistor circuit 162 is turned off to stop the output of the output terminal OUT.

As described above, the power management driver 100A uses sequence controller 160 which has a simple structure for adjusting the output sequence of the source drive voltage AVDD, without using additional regulator or voltage converter. The pass transistor circuit 162 in the sequence controller 160 may include a MOS transistor having very low on-state resistance to reduce power consumption. The pass transistor circuit 162 may also include the first and second body diodes connected in opposing directions and first and second switches SW1 and SW2. As a result, noise and/or interference based on operation of the pass transistor circuit 162 may be reduced or prevented and image output performance may be improved.

Figure 7:
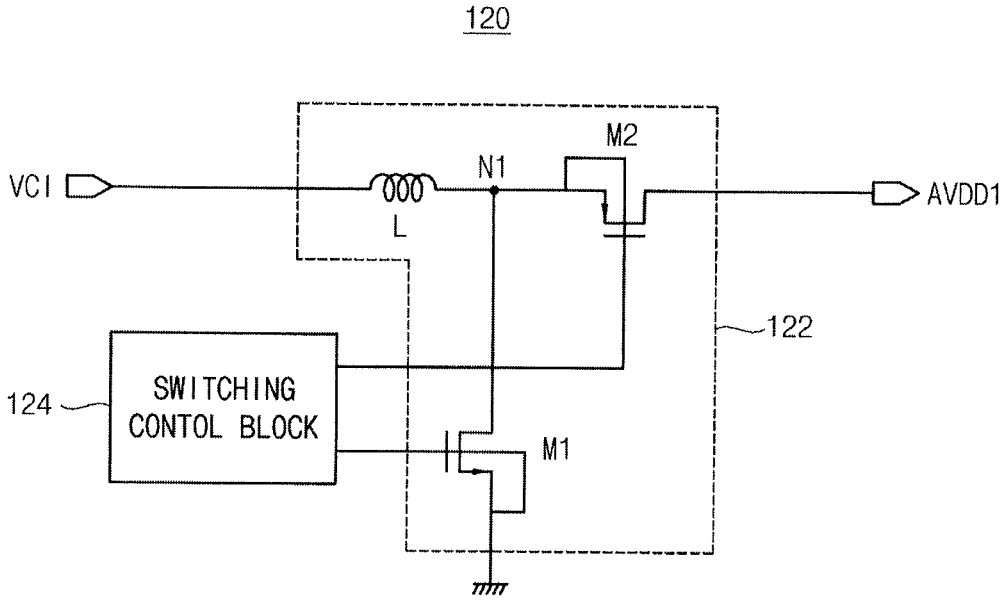
FIG. 7 illustrates an embodiment of a boost converter.

FIG. 7 illustrates an embodiment of the boost converter 120 in the power management driver 100A of FIG. 2. The boost converter 120 converts an input voltage VCI to a source drive voltage AVDD1.

Referring to FIG. 7, the boost converter 120 includes a switch block 122 and a switch control block 124. The switch block 122 includes a first switch transistor M1, a second switch transistor M2, and an inductor L. The inductor L is connected between an input terminal to which the input voltage VCI is applied and a first node N1.

The first switch transistor M1 is connected between the first node N1 and a ground, and is turned on based on a control signal from the switch control block 124 to allow current to flow through the inductor L.

The second switch transistor M2 is connected between the first node N1 and an output terminal for outputting the source drive voltage AVDD1. The first switch transistor M1 and the second switch transistor M2 may be alternately turned on or off. After the first switch transistor M1 is turned on and an electromotive force is generated by the inductor L, the second switch transistor M2 is turned on to convert the input voltage VCI to the source drive voltage AVDD1. The switch block 122 provides the source drive voltage AVDD1 to an input terminal IN of the sequence controller 160 and input terminals of the regulators 140.

The switch control block 124 controls on-off operations of the first and second switch transistors M1 and M2, so that the first and second switch transistors M1 and M2 are alternately turned on/off.

Figure 8:
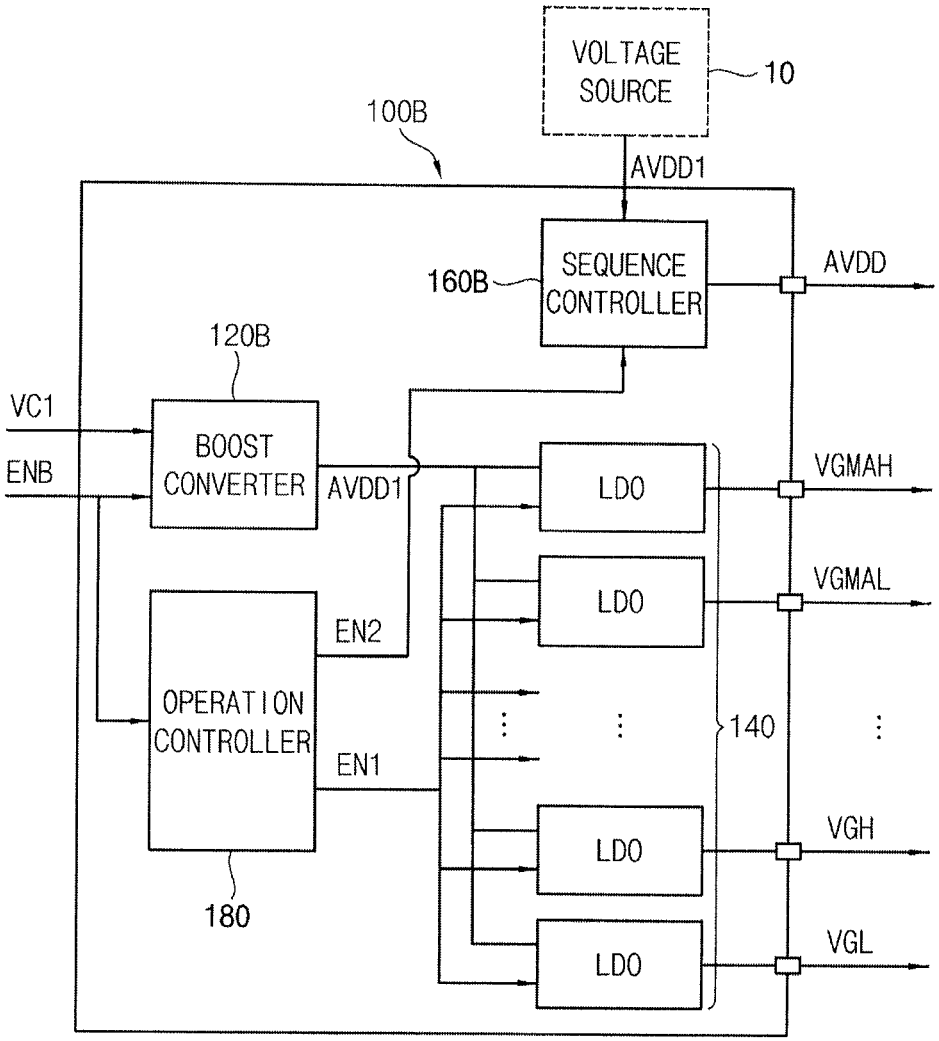
FIG. 8 illustrates another embodiment of a power management driver.

FIG. 8 illustrates another embodiment of a power management driver 100B, which is substantially the same as the power management driver 100A in FIGS. 2 to 7 except for the boost converter 120B and the sequence controller 160B.

Referring to FIGS. 1, 2, and 8, the power management driver 100B includes a boost converter 120B, a plurality of regulators 140, a sequence controller 160B, and an operation controller 180. The boost controller 120B converts an input voltage VCI to a source drive voltage AVDD1 for driving the source driver 400 based on a drive enable signal EN. In one embodiment, the boost converter 120B provides the source drive voltage AVDD1 to only the regulators 140. Accordingly, the source drive voltage AVDD1 generated in the boost controller 120B may not be provided to the sequence controller 160B.

The regulators 140 regulate the source drive voltage AVDD1 to generate a plurality of drive voltages, each corresponding to a device such as a gate driver 300, the source driver 400, etc. The regulators 140 may be, for example, LDO regulators.

The sequence controller 160B controls the timing at which the source drive voltage AVDD1 is provided to the source driver 400. The sequence controller 160B may include a pass transistor circuit and a comparator. In one embodiment, the sequence controller 160B is connected to an external voltage source 10 to independently receive the source drive voltage. The sequence controller 160B includes an input terminal for receiving the source drive voltage AVDD1 from the voltage source 10. Thus, a voltage drop due to conduction loss between an output terminal of the boost converter 120 and the sequence controller may be reduced or prevented.

The operation controller 180 adjusts active periods of first and second control signals EN1 and EN2 to control the regulators 140 and the sequence controller 160B. The operation controller 180 may generate the first and second control signals EN1 and EN2 based on the drive enable signal EN.

Accordingly, the sequence controller 160B receives the source drive voltage AVDD1 from the external voltage source 10, so that the source drive voltage AVDD1 may be provided more stably to the source driver 400.

Figure 9:
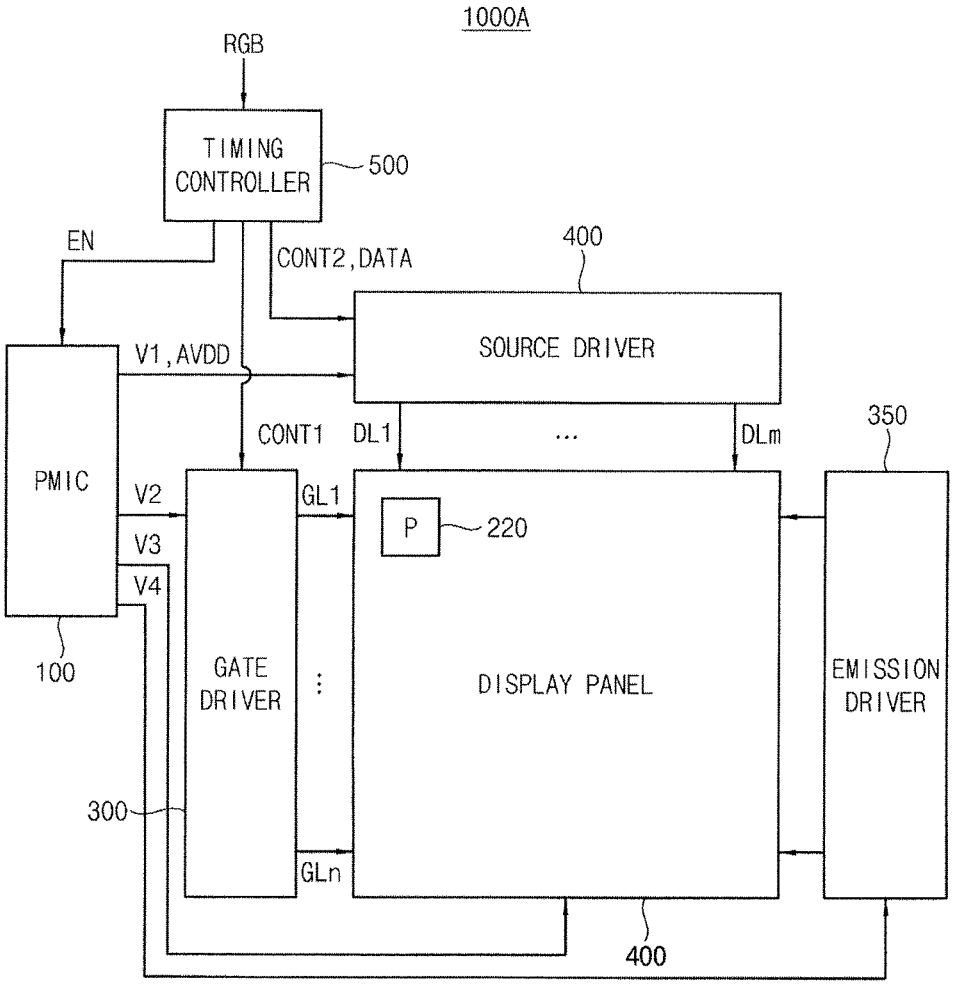
FIG. 9 illustrates an embodiment of a display device.

FIG. 9 illustrates an embodiment of a display device 1000A which is substantially the same as the power management driver 1000 in FIG. 1, except for an emission driver 350.

Referring to FIGS. 1 and 9, the display device 1000A includes a power management driver 100, a display panel 200, a gate driver 300, an emission driver 350, a source driver 400, and a timing controller 500. The power management driver 100 controls a drive voltage (e.g., a level of drive voltage, sequence of the drive voltage, etc.) provided to the display panel 200, the gate driver 300, the emission driver 350, and the source driver 400.

The power management driver 100 includes a boost converter, a plurality of regulators, a sequence controller, and operation controller. The boost converter converts an input voltage VCI to a source drive voltage AVDD for driving the source driver 400 based on a drive enable signal EN. The regulators regulate the source drive voltage AVDD to generate a plurality of drive voltages V1, V2, V3, and V4. The sequence controller controls the timing at which the source drive voltage AVDD is provided to the source driver 400. The operation controller adjusts active periods of first and second control signals to control the regulators and the sequence controller. The drive voltages V1, V2, V3, and V4 may be applied to the source driver 400, the gate driver 300, the display panel 200, and the emission driver 350, respectively.

In one embodiment, the regulators output the drive voltage V1, V2, V3, and V4 when the first control signal is activated. The sequence controller may provide the source drive voltage AVDD to the source driver 400, for example, when the second control signal is activated. In one embodiment, the drive voltage V1 corresponds to an uppermost gamma voltage and a lowermost gamma voltage for driving the source driver 4000. The drive voltages V2 and V4 correspond to a high direct current (DC) voltage and a low DC voltage for driving the gate driver 300 and the emission driver 350. The drive voltage V3 corresponds to an initialization voltage for initializing pixels (e.g., anodes of organic light emitting diodes) in the display panel 200.

The operation controller activates the second control signal after activating the first control signal having a predetermined delay time. In one embodiment, the sequence controller may be connected to an external voltage source to independently receive the source drive voltage AVDD. For example, the display device 1000A may include a voltage source or a battery to generate the source drive voltage AVDD and provide the source driver voltage AVDD to the sequence controller.

As described above, and in accordance with the present embodiment, the display device 1000A includes power management driver 100 which uses sequence controller 160 having a simple structure for adjusting the output sequence of the source drive voltage AVDD, without additional regulator or voltage converter. Thus, power consumption of the display device 1000A may be reduced and image output performance may be improved.

Figure 10:
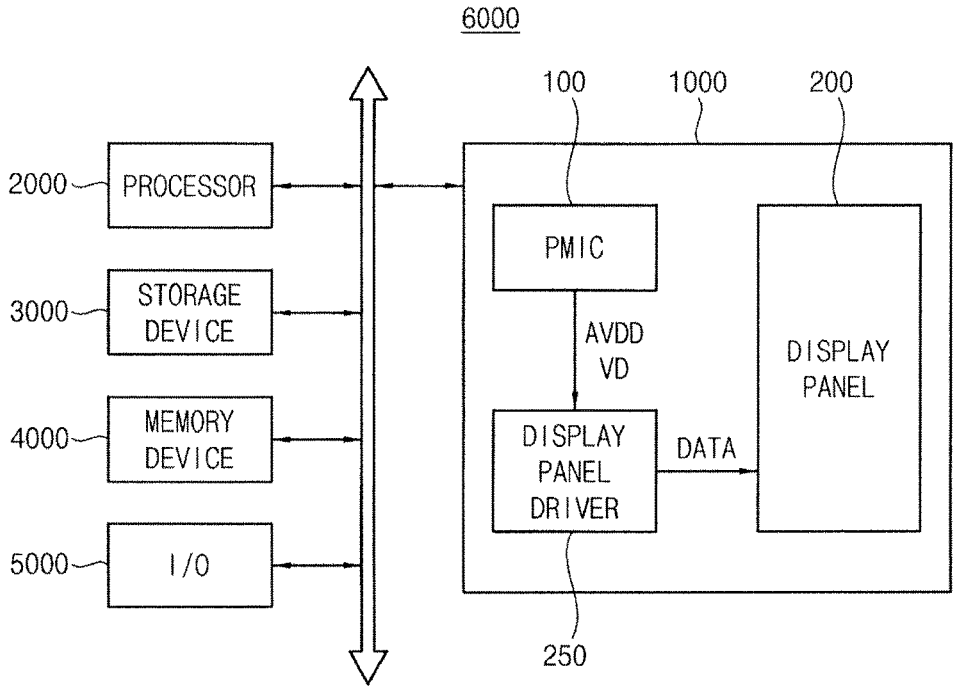
FIG. 10 illustrates an embodiment of a system.

FIG. 10 illustrates an embodiment of a system 6000 which includes a display device 1000, a processor 2000, and a storage device 3000. The storage device 3000 stores image data, and may include, for example, a solid state drive (SSD), a hard disk drive (HDD), a CD-ROM, etc.

The display device 1000 displays the image data stored in the storage device 3000. The display device 1000 includes the power management driver 100, the display panel 200, and a display panel driver 250. The display panel 200 includes a plurality of pixels that emit light based on data signals DATA to for an image. The display panel driver 250 provides the data signal DATA to the display panel 200. The display panel driver 250 includes a timing controller, a gate driver, and a source driver. The power management driver 100 provides a drive voltage for driving the display panel 250 to the display panel driver 250 according to a certain sequence based on a drive enable signal.

The power management driver 100 includes a boost converter to convert an input voltage to a source drive voltage AVDD for driving the source driver based on the drive enable signal, a plurality of regulators to regulate the source drive voltage AVDD to generate a plurality of drive voltages, a sequence controller to control a timing at which the source drive voltage AVDD is provided to the source driver, and an operation controller to adjust active periods of first and second control signals to control the regulators and the sequence controller.

The display device 1000 may be, for example, an organic light emitting display device. In this case, each of the pixels in the display panel 200 includes an organic light emitting diode OLED. The display device 1000 may have the same or substantially the same structure as the display device 1000 or 1000A in FIGS. 1 and 9.

The processor 2000 controls the storage device 3000 and the display device 1000. The processor 2000 performs specific calculations, computing functions for various tasks, operations, etc. The processor 2000 may include, e.g., a microprocessor or central processing unit (CPU). The processor 2000 may be coupled to the storage device 3000 and the display device 1000 via an address bus, a control bus, and/or a data bus. In addition, the processor 2000 may be coupled to an extended bus, such as a peripheral component interconnection (PCI) bus.

The system 6000 may include a memory device 4000 and an I/O device 5000. In one example embodiment, the system 6000 may include a plurality of ports that communicate, for example, with a video card, a sound card, a memory card, a universal serial bus (USB) device, other electric devices, etc.

The memory device 4000 stores data for operations of the system 6000. For example, the memory device 4000 may include at least one volatile memory device, such as a dynamic random access memory (DRAM) device, a static random access memory (SRAM) device, etc., and/or at least one non-volatile memory device, such as an erasable programmable read-only memory (EPROM) device, an electrically erasable programmable read-only memory (EEPROM) device, a flash memory device, etc.

The I/O device 5000 includes one or more input devices (e.g., a keyboard, keypad, a mouse, a touch pad, a haptic device, etc.), and/or one or more output devices (e.g., a printer, a speaker, etc.). In one example embodiment, the display device 1000 may be in the I/O device 5000.

The system 6000 may be or include any of a plurality of electronic devices. Examples include a digital television, a cellular phone, a smart phone, a personal digital assistant (PDA), a personal media player (PMP), a portable game console, a computer monitor, a digital camera, an MP3 player, etc.

As described above, and according to the present embodiment, the system 6000 includes a power management driver having a sequence controller with a simple structure for adjusting the output sequence of the source drive voltage AVDD, without additional regulator or voltage converter in the display device. Thus, power consumption for driving the system 6000 may be reduced.

The present embodiments may be applied to any display device and any system including the display device. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

By way of summation and review, a PMIC outputs various drive voltages for driving a display device at predetermined timings based an input voltage and an enable signal from an external device. Such a PMIC includes at least one boost converter and a plurality of LDO regulators. The boost converters or LDO regulators are included in the PMIC to control a voltage output sequence. However, the size of the PMIC and power consumption increases as the number or size of voltages increases. Additionally, when switching circuits for controlling the voltage output sequence are arranged outside the PMIC, a circuit structure of the display device becomes complicated and power consumption increases.

In accordance with one or more of the aforementioned embodiments, a power management driver includes a sequence controller having a pass transistor circuit to control output timing of a source drive voltage, without using an additional regulator or voltage converter.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A power management driver, comprising:

a boost converter to convert an input voltage to a source drive voltage to drive a source driver based on a drive enable signal;

a plurality of regulators to regulate the source drive voltage to generate a plurality of drive voltages, the regulators corresponding to a respective number of predetermined devices;

a sequence controller to control a timing for providing the source drive voltage to the source driver; and an operation controller to adjust active periods of first and second control signals to control the regulators and the sequence controller.

2. The driver as claimed in claim 1, wherein:

the regulators are to output the drive voltages when the first control signal is activated, and the sequence controller is to output the source drive voltage when the second control signal is activated.

3. The driver as claimed in claim 2, wherein the operation controller is to activate the second control signal after activating the first control signal having a predetermined delay time.

4. The driver as claimed in claim 1, wherein the sequence controller includes:

a pass transistor circuit having a gate electrode to receive the second control signal from the operation controller, a first electrode electrically connected to the boost converter, and a second electrode electrically connected to an output terminal for outputting the source drive voltage; and a comparator to compare a first voltage at the first electrode and a second voltage at the second electrode.

5. The driver as claimed in claim 4, wherein the pass transistor circuit includes:

a first body diode connected to the first electrode in a direction of the second electrode;

a second body diode connected to the second electrode in a direction of the first electrode and connected to the first body diode in series;

a first switch connected to the first body diode in parallel; and a second switch connected to the second body diode in parallel, wherein the first and second switches are to be selectively turned on based on an output of the comparator.

6. The driver as claimed in claim 5, wherein:

when the first voltage is greater than a sum of the second voltage and a threshold voltage of the pass transistor circuit, the first switch is to be turned on and the second body diode is to stop the first voltage from reaching the output terminal.

7. The driver as claimed in claim 6, wherein:

when the first voltage is less than or equal to the sum of the second voltage and the threshold voltage of the pass transistor circuit, the first switch is to be turned off.

8. The driver as claimed in claim 5, wherein:

when the first and second signals are activated, the first switch is to be turned off and the second switch is to be turned on to transmit the source drive voltage to the output terminal.

9. The driver as claimed in claim 1, wherein the source drive voltage corresponds to an uppermost voltage for driving a plurality of output buffers in the source driver.

10. The driver as claimed in claim 1, wherein the sequence controller is connected to an external voltage source to independently receive the source drive voltage.

11. The driver as claimed in claim 1, wherein the regulators are low-dropout regulators.

12. A display device, comprising:

a display panel including a plurality of pixels;

a source driver to provide a data voltage to the display panel;

a gate driver to provide a gate signal to the display panel;

a power management driver to control a plurality of drive voltages to be provided to the display panel, the source driver, and the gate driver; and a timing controller to control the source driver, the gate driver, and the power management driver, wherein the power management driver includes:

a boost converter to convert an input voltage to a source drive voltage for driving the source driver based on a drive enable signal;

a plurality of regulators to regulate the source drive voltage to generate the plurality of drive voltages;

a sequence controller to control a timing to provide the source drive voltage to the source driver; and an operation controller to adjust active periods of first and second control signals to control the regulators and the sequence controller.

13. The display device as claimed in claim 12, further comprising:

an emission driver to provide an emission signal to control emission of the pixels.

14. The display device as claimed in claim 13, wherein the power management driver is to provide an emission drive voltage to the emission driver to drive the emission driver.

15. The display device as claimed in claim 12, wherein:

the regulators are to output the drive voltage when the first control signal is activated, and the sequence controller is to output the source drive voltage when the second control signal is activated.

16. The display device as claimed in claim 12, wherein the operation controller is to activate the second control signal after activating the first control signal having a predetermined delay time.

17. The display device as claimed in claim 16, further comprising:

a voltage source to generate the source drive voltage and to provide the source driver voltage to the sequence controller.

18. The display device as claimed in claim 12, wherein the sequence controller includes:

a pass transistor circuit having a gate electrode to receive the second control signal from the operation controller, a first electrode electrically connected to the boost converter, and a second electrode electrically connected to an output terminal to transmit the source drive voltage to the source driver;

a comparator to compare a first voltage at the first electrode and a second voltage at the second electrode;

a first body diode connected to the first electrode in a direction of the second electrode;

a second body diode connected to the second electrode in a direction of the first electrode and connected to the first body diode in series;

a first switch connected to the first body diode in parallel; and a second switch connected to the second body diode in parallel, wherein the first and second switches are to be selectively turned on based on an output of the comparator.

19. The display device as claimed in claim 18, wherein the boost converter is to provide the source drive voltage to the sequence controller.

20. The display device as claimed in claim 12, wherein the source drive voltage corresponds to an uppermost voltage for driving a plurality of output buffers included in the source driver.

* * * * *